US009388672B2

(12) United States Patent
Cunningham et al.

(10) Patent No.: US 9,388,672 B2
(45) Date of Patent: Jul. 12, 2016

(54) WELLBORE SCREENS AND METHODS OF USE THEREOF

(75) Inventors: Scott Cunningham, Grapevine, TX (US); Jean-Marc Lopez, Plano, TX (US); Stephen Michael Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 110 days.

(21) Appl. No.: 14/110,174

(22) PCT Filed: Jun. 8, 2012

(86) PCT No.: PCT/US2012/041529

§ 371 (c)(1),
(2), (4) Date: Oct. 7, 2013

(87) PCT Pub. No.: WO2013/184123

PCT Pub. Date: Dec. 12, 2013

(65) Prior Publication Data

US 2015/0152715 A1 Jun. 4, 2015

(51) Int. Cl.

| | |
|---|---|
| ***E21B 43/08*** | (2006.01) |
| ***E21B 34/08*** | (2006.01) |
| ***E21B 43/10*** | (2006.01) |
| ***E21B 34/06*** | (2006.01) |
| ***E21B 43/12*** | (2006.01) |
| ***E21B 47/06*** | (2012.01) |

(52) U.S. Cl.

CPC ..... *E21B 43/08* (2013.01); *E21B 34/066* (2013.01); *E21B 34/08* (2013.01); *E21B 43/10* (2013.01); *E21B 43/12* (2013.01); *E21B 47/06* (2013.01)

(58) Field of Classification Search

CPC ..... E21B 34/06; E21B 34/08; E21B 34/101; E21B 43/08; E21B 43/10; E21B 43/12; E21B 47/06

See application file for complete search history.

(56) References Cited

U.S. PATENT DOCUMENTS

| | | | | |
|---|---|---|---|---|
| 5,183,110 | A * | 2/1993 | Logan et al. | 166/278 |
| 6,886,634 | B2 * | 5/2005 | Richards | 166/278 |
| 6,978,840 | B2 * | 12/2005 | Henderson | 166/380 |
| 7,789,151 | B2 * | 9/2010 | Langeslag | 166/296 |
| 2003/0111224 | A1 | 6/2003 | Hailey et al. | |
| 2005/0121192 | A1 * | 6/2005 | Hailey et al. | 166/278 |
| 2009/0000787 | A1 * | 1/2009 | Hill et al. | 166/344 |
| 2009/0260835 | A1 | 10/2009 | Malone | |

(Continued)

OTHER PUBLICATIONS

International Search Report and Written Opinion for PCT/US2012/041529 dated Aug. 13, 2013.

*Primary Examiner* — Shane Bomar
*Assistant Examiner* — Christopher Sebesta
(74) *Attorney, Agent, or Firm* — McDermott Will & Emery LLP; Scott Richardson

(57) ABSTRACT

This invention relates to wellbore equipment utilized in conjunction with operations performed in subterranean wells and, in particular, sand control screen assemblies providing secondary flow capabilities. Once sand control screen assembly includes a base pipe having an exterior surface and defining one or more perforations therein, a screen jacket disposed about the exterior surface of the base pipe and having a primary screen axially adjacent a secondary screen, and at least one relief valve configured to open upon experiencing a predetermined fluid pressure, wherein, once opened, the at least one relief valve diverts fluid flow from the primary screen and provides the fluid flow to the secondary screen.

12 Claims, 4 Drawing Sheets

(56) References Cited

U.S. PATENT DOCUMENTS

2009/0288838 A1* 11/2009 Richards ..... 166/374
2010/0139909 A1 6/2010 Tirado et al.
2011/0101613 A1* 5/2011 McRobb et al. ..... 277/312
2012/0048536 A1 3/2012 Holderman et al.
2012/0073801 A1 3/2012 Greci et al.

* cited by examiner

WELLBORE SCREENS AND METHODS OF USE THEREOF

This application is a national stage entry of and claims priority to International Application No. PCT/US2012/41529, entitled "Wellbore Screens and Methods of Use Thereof" and filed on Jun. 8, 2012.

BACKGROUND

This invention relates to wellbore equipment utilized in conjunction with operations performed in subterranean wells and, in particular, sand control screen assemblies that provide secondary flow capabilities.

During hydrocarbon production from subsurface formations, efficient control of the movement of unconsolidated formation particles into the wellbore, such as sand, has always been a pressing concern. Such formation movement commonly occurs during production from completions in loose sandstone or following the hydraulic fracture of a formation. Formation movement can also occur suddenly in the event a section of the wellbore collapses, thereby circulating significant amounts of particulates and fines within the wellbore. Production of these unwanted materials may cause numerous problems in the efficient extraction of oil and gas from subterranean formations. For example, producing formation particles may tend to plug the formation, tubing, and subsurface flow lines. Producing formation particles may also result in the erosion of casing, downhole equipment, and surface equipment. These problems lead to high maintenance costs and unacceptable well downtime.

Numerous methods have been utilized to control the movement or production of these unconsolidated formation particles during production operations. For example, one or more sand control screen assemblies are commonly included in the completion string to regulate and restrict the movement of formation particles. Such sand control screen assemblies are commonly constructed by installing one or more screen jackets on a perforated base pipe. The screen jackets typically include one or more drainage layers, one or more screen elements such as a wire wrapped screen or single or multi layer wire mesh screen, and a perforated outer shroud. The screens can often incorporate resins and/or tackifiers that help keep the particulates in position or otherwise not produced.

Over time, the screen jackets can become plugged with loose particulates and fines, generally referred to herein as a filter cake, which can slow hydrocarbon production or stop production altogether, especially in significantly plugged locations within the wellbore. To clean the screen assemblies and remove the filter cake, acids or other solvents can be injected into the wells in order to remove the filter cake, after which the screen assemblies are often flushed to ensure proper function once more. The process of cleaning the screen assemblies is costly, and can require a significant amount of valuable rig time during which hydrocarbon production is temporarily stopped.

SUMMARY OF THE INVENTION

This invention relates to wellbore equipment utilized in conjunction with operations performed in subterranean wells and, in particular, sand control screen assemblies providing secondary flow capabilities.

In some embodiments, a sand control screen assembly is disclosed. The assembly may include a base pipe having an exterior surface and defining one or more perforations therein; a screen jacket disposed about the exterior surface of the base pipe and having a primary screen arranged axially adjacent a secondary screen; and at least one relief valve configured to open upon experiencing a predetermined fluid pressure, wherein, once opened, the at least one relief valve diverts fluid flow from the primary screen and provides the fluid flow to the secondary screen.

In some embodiments, a method for producing fluids from a formation is disclosed. The method may include introducing a base pipe into a wellbore adjacent the formation, the base pipe having a screen jacket disposed thereabout with a primary screen arranged axially adjacent a secondary screen; drawing a flow of fluids from the formation and into the base pipe via the primary screen; opening at least one relief valve when a differential pressure between an interior of the base pipe and the formation reaches a predetermined pressure threshold; and diverting the flow of fluids through the at least one relief valve and to the secondary screen, thereby bypassing the flow of fluids through the primary screen.

In other embodiments, other sand control screen assemblies are disclosed. In one example, the assembly may include a base pipe having an exterior surface and defining one or more perforations therein; a screen jacket disposed about the exterior surface of the base pipe and having a primary screen concentrically disposed about a secondary screen and thereby forming a first production annulus between the primary and secondary screens; and at least one relief valve configured to open upon experiencing a predetermined fluid pressure, wherein, once opened, the at least one relief valve diverts a fluid flow from passing through both the primary and secondary screens to passing through only the secondary screen.

In yet other embodiments, other methods for producing fluids from a formation are disclosed. An example of a method may include introducing a base pipe into a wellbore adjacent the formation, the base pipe having a screen jacket disposed thereabout with a primary screen concentrically disposed about a secondary screen and thereby forming a first production annulus between the primary and secondary screens; drawing a flow of fluids from the formation and into the base pipe via both the primary and secondary screens; opening at least one relief valve when a differential pressure between the first production annulus and the formation reaches a predetermined pressure threshold; and diverting the flow of fluids through the at least one relief valve and to the secondary screen, thereby bypassing the flow of fluids through the primary screen.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This invention relates to wellbore equipment utilized in conjunction with operations performed in subterranean wells and, in particular, sand control screen assemblies providing secondary flow capabilities.

The exemplary sand control screen assemblies disclosed herein provide an alternate pathway for production fluids to enter the base pipe when a primary filter media or screen becomes plugged or otherwise ineffectual. When the primary screen becomes plugged, the formation fluids may be diverted to a secondary screen which then provides production filtering and continuous flow of production fluids. Consequently, instead of losing production through a plugged filter, the embodiments disclosed herein provide a backup system that allows continual production of fluids into the base pipe, thereby possibly increasing the life of a producing zone. As will be appreciated by those skilled in the art, this could prove especially advantageous in the event a portion of the wellbore collapses and significant amounts of particulates and fines are suddenly circulated within the wellbore and plug the primary screen. Once the primary screen becomes plugged, the secondary screen may be activated (e.g., automatically) to allow the flow of production fluids to continue uninterrupted. Embodiments disclosed herein also provide sand control screen assemblies that promote self-cleaning of the primary screen, thereby avoiding the costly and time consuming process of cleaning the screen assemblies.

Figure 1:
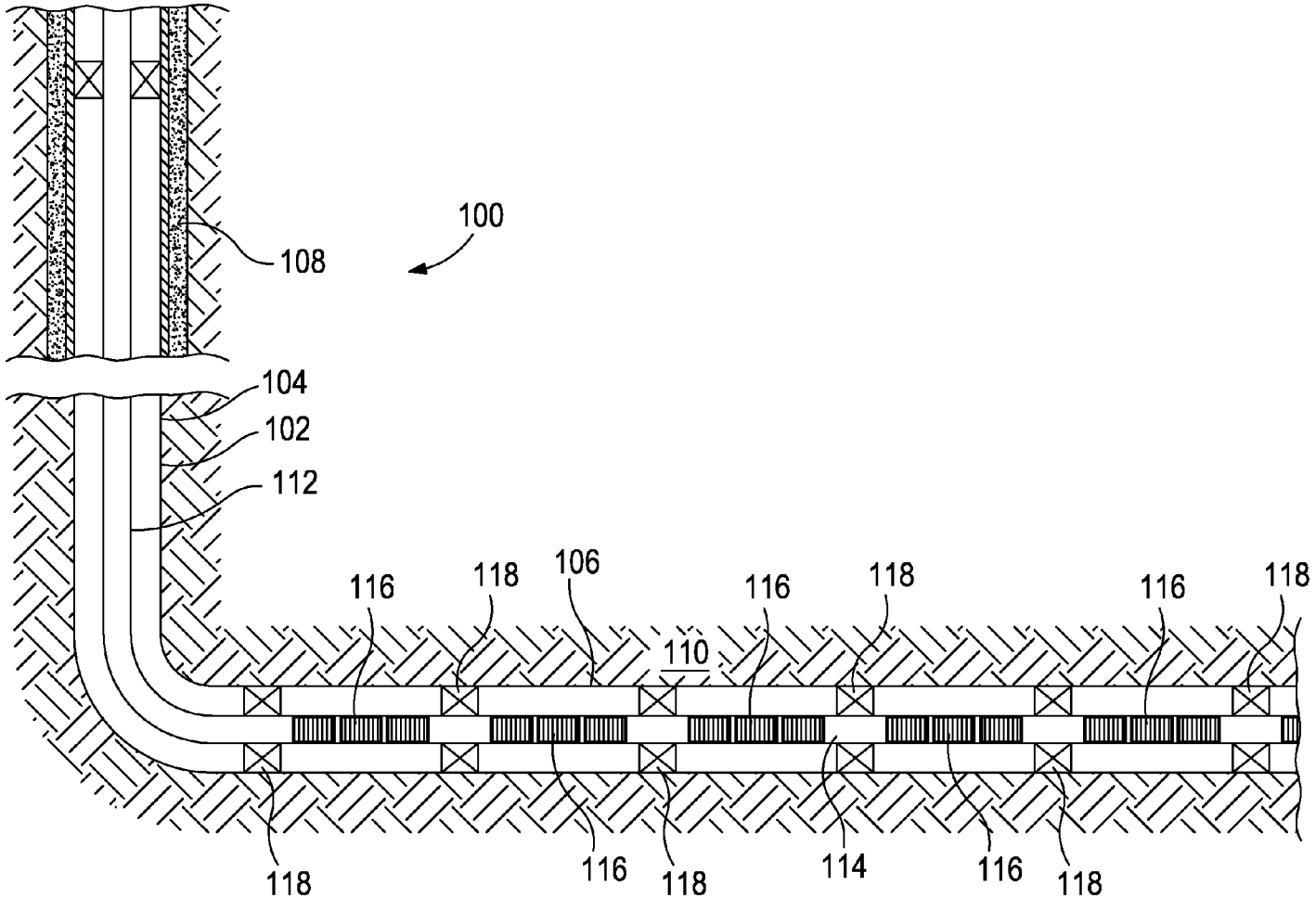
FIG. 1 illustrates a well system that can employ the sand control screen assemblies described herein.

Referring to FIG. 1, illustrated is a well system 100, according to one or more embodiments of the disclosure. As depicted, the well system 100 includes a wellbore 102 that extends through various earth strata and has a substantially vertical section 104 extending to a substantially horizontal section 106. The upper portion of the vertical section 104 may have a casing string 108 cemented therein, and the horizontal section 106 may extend through a hydrocarbon bearing subterranean formation 110. In at least one embodiment, the horizontal section 106 may be arranged within or otherwise extend through an open hole section of the wellbore 102.

A tubing string 112 may be positioned within the wellbore 102 and extend from the surface. The tubing string 112 provides a conduit for fluids extracted from the formation 110 to travel to the surface. At its lower end, the tubing string 112 may be coupled to a completion string 114 arranged within the horizontal section 106. The completion string 114 serves to divide the completion interval into various production intervals adjacent the formation 110. As depicted, the completion string 114 may include a plurality of sand control screen assemblies 116 axially offset from each other along portions of the completion string 114. Each screen assembly 116 may be positioned between a pair of packers 118 that provides a fluid seal between the completion string 114 and the wellbore 102, thereby defining corresponding production intervals. In operation, the screen assemblies 116 serve the primary function of filtering particulate matter out of the production fluid stream such that the particulates and other fines are not produced to the surface.

It should be noted that even though FIG. 1 depicts the screen assemblies 116 as being arranged in an open hole portion of the wellbore 102, embodiments are contemplated herein where one or more of the screen assemblies 116 is arranged within cased portions of the wellbore 102. Also, even though FIG. 1 depicts a single screen assembly 116 arranged in each production interval, it will be appreciated by those skilled in the art that any number of screen assemblies 116 may be deployed within a particular production interval without departing from the scope of the disclosure. In addition, even though FIG. 1 depicts multiple production intervals separated by the packers 118, it will be understood by those skilled in the art that the completion interval may include any number of production intervals with a corresponding number of packers 118 arranged therein. In other embodiments, the packers 118 may be entirely omitted from the completion interval, without departing from the scope of the disclosure.

Further, even though FIG. 1 depicts the screen assemblies 116 as being arranged in a generally horizontal section 106 of the wellbore 102, those skilled in the art will readily recognize that the screen assemblies 116 are equally well suited for use in wells having other directional configurations including vertical wells, deviated wellbores, slanted wells, multilateral wells, combinations thereof, and the like. Accordingly, the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
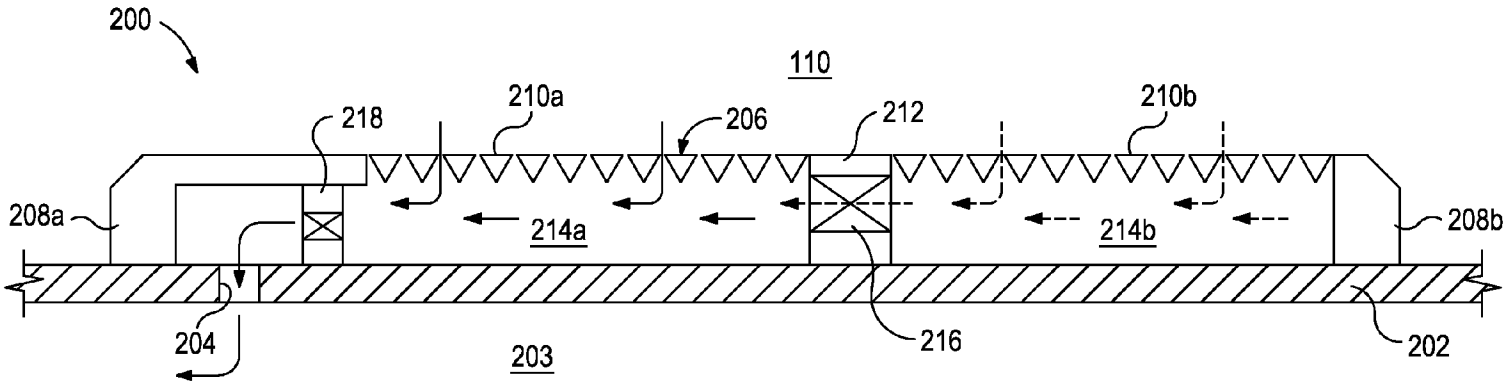
FIG. 2 illustrates an exemplary sand control screen assembly, according to one or more embodiments.

Referring now to FIG. 2, illustrated is an exemplary sand control screen assembly 200, according to one or more embodiments. Along with the other screen assemblies described in greater detail below, the sand control screen assembly 200 may replace the screen assembly 116 described in FIG. 1 and otherwise be used in the exemplary well system 100 depicted therein. The screen assembly 200 may include a base pipe 202 that defines one or more openings or perforations 204 configured to provide fluid communication between the interior 203 of the base pipe and the formation 110. The screen assembly 200 may further include a screen jacket 206 that is attached or otherwise coupled to the exterior of the base pipe 202. In operation, the screen jacket 206 may serve as a filter medium designed to allow fluids derived from the formation 110 to flow therethrough but prevent the influx of particulate matter of a predetermined size.

In some embodiments, the screen jacket 206 includes a first connector ring 208*a* arranged about the base pipe 202 at the uphole end of the screen jacket 206 and a second connector ring 208*b* arranged about the base pipe 202 at the downhole end of the screen jacket 206. The first and second connector rings 208*a,b* provide a mechanical interface between the base pipe 202 and the opposing ends of the screen jacket 206. Each connector ring 208*a,b* may be formed from a metal such as 13 chrome, 304L stainless steel, 316L stainless steel, 420 stainless steel, 410 stainless steel, Incoloy 825, or similar alloys. Moreover, each connector ring 208*a,b* may be coupled or otherwise attached to the outer surface of base pipe 202 by being welded, brazed, threaded, combinations thereof, or the like. In other embodiments, however, one or more of the connector rings 208*a,b* may be an integral part of the screen jacket 206, and not a separate component thereof.

The screen jacket 206 may further include one or more screens arranged about the base pipe 202, for example, a primary screen 210*a* and a secondary screen 210*b*. Each of the primary and secondary screens 210*a,b* may be characterized as a filter medium designed to allow fluids to flow therethrough but prevent the influx of particulate matter of a predetermined size. In some embodiments, the primary and secondary screens 210*a,b* may be fluid-porous, particulate restricting devices made from of a plurality of layers of a wire mesh that are diffusion bonded or sintered together to form a fluid porous wire mesh screen. In other embodiments, however, the screens 210*a,b* may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. Those skilled in the art will readily recognize that several other mesh designs are equally suitable, without departing from the scope of the disclosure. In other embodiments, however, the primary and secondary screens 210*a,b* may include a single layer of wire mesh, multiple layers of wire mesh that are not bonded together, a single layer of wire wrap, multiple layers of wire wrap or the like, that may or may not operate with a drainage layer.

As illustrated, the primary screen 210*a* may be axially adjacent the secondary screen 210*b* and radially offset a short distance from the base pipe 202. The primary screen 210*a* may be coupled or otherwise attached to the first connector ring 208*a* at its uphole end and the secondary screen 210*b* may be coupled or otherwise attached to the second connector ring 208*b* at its downhole end. In one or more embodiments, however, the first and second connector rings 208*a,b* may be omitted from the screen assembly 200 and the primary screen 210*a* may be coupled directly to the base pipe 202 at its uphole end and the secondary screen 210*b* may be coupled directly to the base pipe 202 at its downhole end.

In at least one embodiment, the primary and secondary screens 210*a,b* may be coupled to and/or otherwise separated by a screen isolator 212. In other embodiments, however, the primary and secondary screens 210*a,b* may be contiguous lengths and otherwise disposed over the top of the screen isolator 212. In any event, the screen isolator 212 may be configured to support the primary and secondary screens 210*a,b* in a radially-offset relationship with the base pipe 202 so as to define a first production annulus 214*a* and a second production annulus 214*b* between the base pipe 202 and the primary and secondary screens 210*a,b*, respectively.

The screen isolator 212 may be arranged about the base pipe 202 and coupled thereto. As illustrated, the screen isolator 212 may include a relief valve 216 disposed therein and configured to provide fluid communication between the first and second production annuli 214*a,b*. In some embodiments, the relief valve 216 may be a rupture disc, a check valve, or any other flow regulating device configured to open upon experiencing a predetermined fluid pressure. In other embodiments, the relief valve 216 may be a mechanical valve configured to actuate to an open position upon being triggered once the predetermined pressure is sensed. Once the predetermined pressure is reached, the relief valve 216 may be configured to open and provide fluid communication between the first and second annuli 214*a,b*.

The screen assembly 200 may also include a flow regulator 218 arranged within or substantially adjacent the first connector ring 208*a*. In operation, the flow regulator 218 may be configured to regulate fluid flow to the one or more perforations 204 in the base pipe 202 from the first and second production annuli 214*a,b*. In one embodiment, the flow regulator 218 is an inflow control device, as known by those skilled in the art. In other embodiments, however, the flow regulator 218 may simply define a hole therein which serves to restrict flow to the interior 203 of the base pipe 202 via the one or more perforations 204. In yet other embodiments, the flow regulator 218 may be omitted altogether from the screen assembly 200, without departing from the scope of the disclosure.

In operation, the sand control screen assembly 200 may be configured to initially draw in fluids from the formation 110 via the primary screen 210*a*. As indicated by the arrows, the fluid may flow into the first production annulus 214*a*, pass through the flow regulator 218 and the one or more perforations 204, and eventually flow into the interior 203 of the base pipe 202 for production to the surface. Over time, however, the primary screen 210*a* may become plugged with particulates and/or other fines circulating within the fluids derived from the formation 110, thereby restricting fluid flow into the first production annulus 214*a* via the primary screen 210*a*. As the primary screen 210*a* becomes more and more plugged with particulate matter, a differential pressure between the first annulus 214*a* (e.g., the interior 203 of the base pipe 202) and the formation 110 is created and correspondingly increases. This differential pressure is also experienced across the relief valve 216, since the second production annulus 214*b* remains at essentially at the same pressure as the formation 110 until the relief valve 216 is opened.

Eventually, the differential pressure across the relief valve 216 will reach a predetermined pressure threshold, thereby causing the relief valve 216 to be opened or otherwise actuated to enable fluid flow therethrough. For example, in embodiments where the relief valve 216 is a rupture disc, the rupture disc is designed to rupture or otherwise be perforated once the differential pressure reaches the predetermined pressure threshold. Similarly, in embodiments where the relief valve 216 is mechanically-actuated, an actuator or the like may be triggered to open the relief valve 216 once the predetermined pressure threshold is sensed. With the relief valve 216 opened, fluid from the formation 110 may then commence to flow through the secondary screen 210*b* and into the second production annulus 214*b* which feeds the fluid into the first production annulus 214*a* via the relief valve 216. As the fluid flows through the secondary screen 210*b*, it is filtered as it would have been through the primary screen 210*a*. Consequently, the secondary screen 210*b* may serve as a back up to the primary screen 210*a* by providing formation fluid to the interior 203 of the base pipe 202 when the primary screen 210*a* becomes plugged or otherwise ineffective. As a result, a continuous and uninterrupted flow of formation fluid is provided to the surface.

As can be appreciated, the relief valve 216 can be designed to withstand varying differential pressures. Accordingly, the relief valve 216 may be configured or otherwise designed to open at different predetermined pressure thresholds. Since pressures in the subterranean formation 110 may vary from wellbore to wellbore, the predetermined pressure threshold fro each relief valve 216 may likewise vary. This may prove advantageous in intelligently designing completion strings 114 (FIG. 1) with specialized relief valves 216 that may be selectively designed to open at particularized predetermined pressure thresholds known to correspond with the particular formation 110, thus ensuring a constant flow of formation fluids to the surface.

Figure 3:
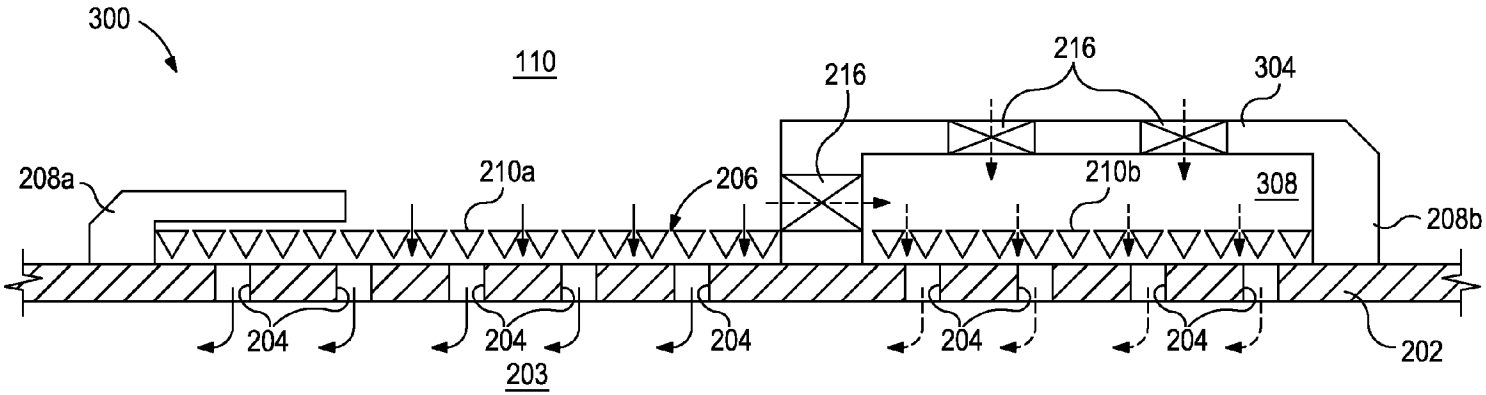
FIG. 3 illustrates another exemplary sand control screen assembly, according to one or more embodiments.

Referring now to FIG. 3, illustrated is another exemplary sand control screen assembly 300, according to one or more embodiments disclosed. The screen assembly 300 may be similar in some respects to the screen assembly 200 of FIG. 2. Accordingly, the screen assembly 300 may be best understood with reference to FIG. 2, wherein like numerals indicate like elements that will not be described again in detail. As illustrated, the screen jacket 206 may again include the primary and secondary screens 210*a,b* arranged about the base pipe 202 and axially offset from each other. Moreover, the screen jacket 206 again includes the first connector ring 208*a* arranged about the base pipe 202 at the uphole end of the screen jacket 206 and the second connector ring 208*b* arranged about the base pipe 202 at the downhole end of the screen jacket 206.

The second connector ring 208*b*, however, may further include a shroud 304 extending axially from the connector ring 208*b* and a screen isolator 306 extending radially from the shroud 304 and being coupled to or otherwise in biasing engagement with the base pipe 202. The combination of the second connector ring 208*b*, the shroud 304, and the screen isolator 306 may define a production annulus 308. The secondary screen 210*b* may be arranged within the production annulus 308 and therefore substantially isolated from the formation 110.

The screen isolator 306 may generally interpose the primary and secondary screens 210*a,b*. In one or more embodiments, the screen isolator 306 may have one or more relief valves 216 (one shown) disposed therein and configured to provide fluid communication between the formation 110 and the secondary screen 210*b* when opened. Likewise, in one or more embodiments, the shroud 304 may include one or more relief valves 216 (two shown) arranged therein and also configured to provide fluid communication between the formation 110 and the secondary screen 210*b* when opened.

In operation, the sand control screen assembly 300 may initially draw fluids from the formation 110 and into the interior 203 of the base pipe 202 via the primary screen 210*a*; the primary screen 210*a* being bounded at its uphole end with a first connector ring 208*a*. Over time, the primary screen 210*a* may become plugged with particulates, thereby restricting fluid flow into the base pipe 202 via the one or more perforations 204 defined in the base pipe 202 radially adjacent the primary screen 210*a*. Restricting the fluid flow through the primary screen 210*a* may generate a differential pressure between the interior 203 of the base pipe 202 and the formation 110. Likewise, since the production annulus 308 is essentially at the same pressure as the interior 203 of the base pipe 202, this same differential pressure will also be experienced across the one or more relief valves 216 arranged within the shroud 304 and/or the screen isolator 306.

As the primary screen 210*a* becomes increasingly plugged, the differential pressure across the relief valves 216 correspondingly increases until reaching the predetermined pressure threshold of the relief valves 216, at which point one or all of the relief valves 216 may be configured to be opened or otherwise actuated to enable fluid flow therethrough. With the relief valve(s) 216 opened, fluid from the formation 110 may then commence to flow through the secondary screen 210*b* and into the interior 203 of the base pipe 202 via the one or more perforations 204 defined in the base pipe 202 radially adjacent the secondary screen 210*a*. Consequently, the secondary screen 210*b* may again serve as a back up to the primary screen 210*a* in providing formation 110 fluid to the interior 203 of the base pipe 202 when the primary screen 210*a* becomes plugged or otherwise ineffective. Moreover, fluid may flow into the production annulus 308 either radially and/or axially since the relief valves 216 may be arranged in either the shroud 304 or the screen isolator 306, or both. As a result, a continuous and uninterrupted flow of formation fluid is again provided to the surface.

While FIG. 3 depicts three relief valves 216 disposed within the shroud 304 and/or the screen isolator 306, those skilled in the art will readily recognize that more or less than three relief valves 216 may be employed without departing from the scope of the disclosure. The number of relief valves 216 may depend, in at least one embodiment, on desired flow rates. Moreover, while FIG. 3 depicts the sand control screen assembly 300 as extending along a portion of an individual base pipe 202, it will be appreciated that the screen assembly 300, or any of the screen assemblies generally described herein, may be configured to extend across portions of two or more individual base pipes, such as by straddling base pipe connection points.

Figure 4:
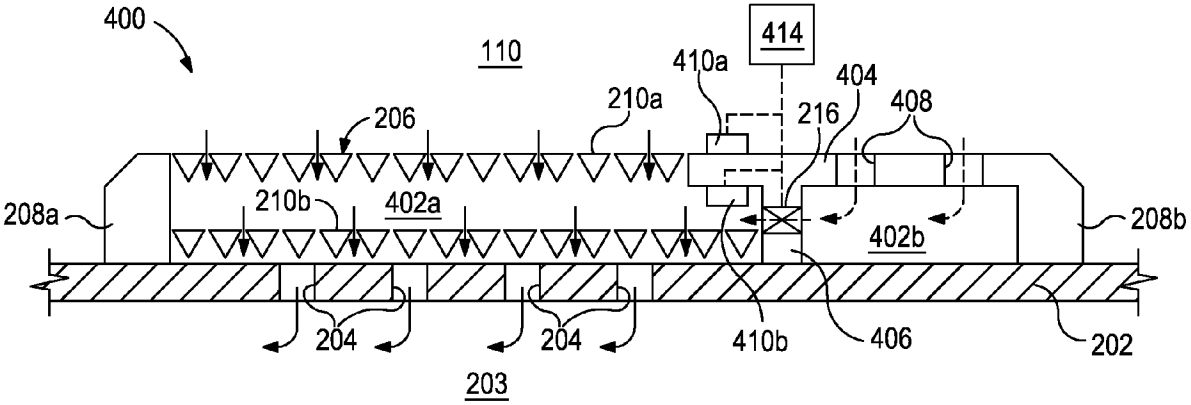
FIG. 4 illustrates another exemplary sand control screen assembly, according to one or more embodiments.

Referring now to FIG. 4, illustrated is another exemplary sand control screen assembly 400, according to one or more embodiments disclosed. The screen assembly 400 may be similar in some respects to the screen assembly 200 of FIG. 2 and therefore may be best understood with reference thereto, where like numerals will indicate like elements not described again. Similar to the screen assembly 200 of FIG. 2, the screen assembly 400 may have primary and secondary screen assemblies 210*a,b* arranged about the base pipe 202; the base pipe 202 defining the one or more perforations 204 therein. Unlike the screen assembly 200 of FIG. 2, however, the primary and secondary screen assemblies 210*a,b* in the screen assembly 400 may be concentrically disposed about the base pipe 202.

Specifically, the secondary screen 210*a* may be arranged adjacent the base pipe 202 and the primary screen 210*b* may be radially offset a short distance from the secondary screen 210*b* such that a concentric relationship is generated between the two screens 210*a,b* and a first production annulus 402*a* is defined therebetween. Moreover, the first and second connector rings 208*a,b* may again axially bound the primary and secondary screen assemblies 210*a,b*, however, the first connector ring 208*a* may be configured to be coupled to both the primary and secondary screens 210*a,b* on their respective uphole ends, and the second connector ring 208*b* may be configured to be coupled to both the primary and secondary screens 210*a,b* on their respective downhole ends.

The second connector ring 208*b* may include a shroud 402 extending axially from the connector ring 208*b* and a valve housing 404 extending radially from the shroud 404 and being coupled to or otherwise in biasing engagement with the base pipe 202. The combination of the second connector ring 208*b*, the shroud 402, and the valve housing 404 may define a second production annulus 402*b*. The shroud 404 may define one or more holes 408 therein, and the one or more holes 408 may provide fluid communication between the formation 110 and the second production annulus 402*b*. In one embodiment, the corresponding downhole ends of the primary and secondary screens 210*a,b* may be coupled to the valve housing 406 and shroud 404, respectively. The valve housing 406 may have a relief valve 216 arranged or otherwise disposed therein. When opened, the relief valve 216 may be configured to provide fluid communication between the first and second production annuli 402*a,b*.

In operation, because of the concentric arrangement of the primary and secondary screens 210*a,b*, the sand control screen assembly 400 may initially draw in fluids from the formation 110 and into the interior 203 of the base pipe 202 via both the primary screen 210*a* and the secondary screen 210*b*. In particular, the primary screen 210*a* may be configured to substantially filter the incoming fluids derived from the formation 110 and feed the filtered fluids into the first production annulus 402*a* and to the secondary screen 210*b*. The secondary screen 210*b* may be configured to convey the filtered fluids to the interior 203 of the base pipe 202 via the one or more perforations 204 defined radially adjacent thereto in the base pipe 202. Over time, however, the primary screen 210*a* may become plugged with particulates, thereby restricting fluid flow into first production annulus 402*a* and generating a differential pressure between the first production annulus 402*a* (e.g., the interior 203 of the base pipe 202) and the formation 110. Since the second production annulus 402*b* is essentially at the same pressure as the formation 110 via the one or more holes 408, this same differential pressure may also be experienced across the relief valve 216 arranged within the valve housing 406.

As the primary screen 210*a* becomes increasingly plugged, the differential pressure across the relief valve 216 correspondingly increases until reaching its predetermined pressure threshold, at which point the relief valve 216 may be configured to be opened or otherwise actuated to enable fluid flow therethrough. With the relief valve 216 opened, fluid from the formation 110 may then commence to flow through the one or more holes 408 and into the second production annulus 402*b* which feeds the incoming fluid into the first production annulus 214*a* via the relief valve 216. Accordingly, the relief valve 216 allows the fluid from the formation 110 to bypass a plugged primary screen 210*a* and commence filtration of the formation fluids using the secondary screen 210*b*, which continues to feed the filtered fluids to the interior 203 of the base pipe 202 via the one or more perforations 204. As such, the secondary screen 210*b* may again serve as a back up to the primary screen 210*a* in providing formation fluid to the interior 203 of the base pipe 202 when the primary screen 210*a* becomes plugged or otherwise ineffective.

In one or more embodiments, the sand control screen assembly 400 may further include one or more sensors configured to sense the differential pressure between the first production annulus 402*a* and the formation 110 and trigger the actuation of the relief valve 216 when the predetermined pressure threshold is reached. Specifically, a first sensor 410*a* may be arranged on the exterior of the assembly 400, such as by being coupled to the outer surface of the shroud 404 or the like. The first sensor 410*a* may be configured to measure the pressure of the fluids within the formation 110 and report real-time pressure measurements to a computing device 414 communicably coupled thereto. A second sensor 410*b* may be arranged within the first production annulus 402*a* and configured to measure the pressure in the first production annulus 402*a* and report the same to the computing device 414 also communicably coupled thereto.

The computing device 414 may be a computer including a processor configured to execute one or more sequences of instructions or code stored on a non-transitory, computer-readable medium. The processor can be, for example, a general purpose microprocessor, a microcontroller, a digital signal processor, an artificial neural network, or any like suitable entity that can perform calculations or other manipulations of data. In some embodiments, the computing device 414 may further include a memory or any other suitable storage device or medium.

The computing device 414 may be configured to receive the pressure measurements derived from both the first and second sensors 410*a,b* and calculate the pressure differential existing between the first production annulus 402*a* and the formation 110, which, as will be appreciated, is the same pressure differential experienced across the relief valve 216 arranged within the valve housing 406. Once the measured pressure differential reaches a predetermined pressure threshold as recognized by the computing device 414, the computing device 414 may be configured to trigger the opening of the relief valve 216. For example, in embodiments where the relief valve 216 is mechanically, electrically, or hydraulically actuated, an actuator or the like may be triggered by the computing device 414 to open the relief valve 216 once the predetermined pressure threshold is sensed.

In some embodiments, the computing device 414 is omitted and instead the first and second sensors 410*a,b* may be configured to communicate an alert signal, either wired or wirelessly, to a user at the surface. The alert signal may warn the user that the predetermined pressure threshold has been reached in the screen assembly 400 and prompt the user to manually manipulate the relief valve 216 from the surface, such as through remote controlled actuating devices or the like. As a result, the user may be actively involved in diverting the flow of fluids through the relief valve 216 and away from the primary screen 210*a* when the primary screen 210*a* is determined to be plugged or otherwise ineffectual.

In one or more embodiments, the relief valve 216 may be sized or otherwise actuated by the computing device 414 such that the influx of formation fluids into the first production annulus 402*a* therethrough will not only be produced through the secondary screen 210*b*, but also a portion thereof may be flow through the primary screen 210*a* in reverse. In other words, the influx of fluids through the relief valve 216 may increase the pressure within the first production annulus 402*a* such that a portion of the incoming fluids through the relief valve 216 is conveyed in reverse through the primary screen 210*a* and may thereby serve to remove built-up filter cake from the outer surface of the primary screen 210*a* in the process.

Removing the filter cake from the exterior of the primary screen 210*a* will allow more fluid to pass therethrough and thereby serve to reduce the pressure within the first production annulus 402*a*. In one or more embodiments, once the second sensor 410*b* measures a reduced pressure in the first production annulus 402*a*, which may be indicative of a cleansed primary screen 210*a*, the computing device 414 may be configured to trigger the relief valve 216 to close and thereby resume production of fluids through both the primary and secondary screens 210*a,b*. Those skilled in the art will readily recognize that the computing device 414 and corresponding sensors 410*a,b* may be employed in any of the embodiments disclosed herein, without departing from the scope of the disclosure. Moreover, the computing device 414 and corresponding sensors 410*a,b* may be remotely operated from the surface, for example.

Figure 5:
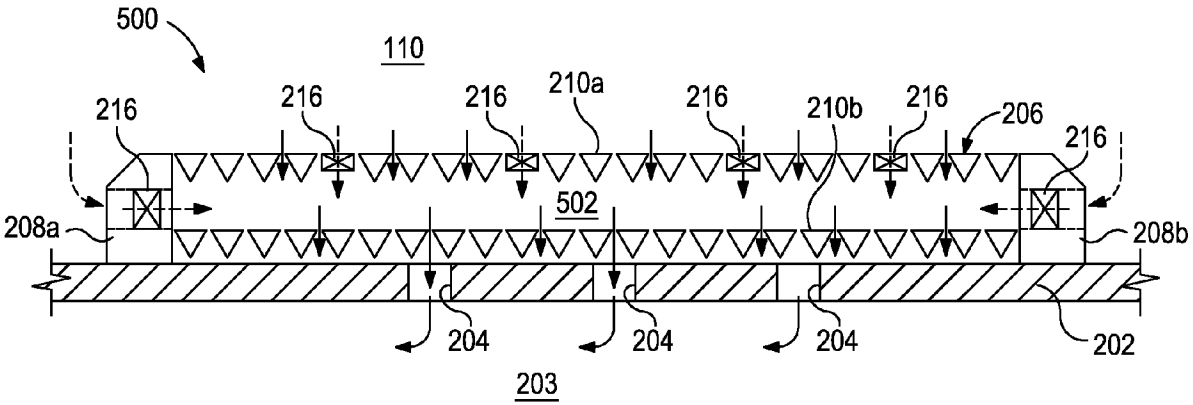
FIG. 5 illustrates another exemplary sand control screen assembly, according to one or more embodiments.

Referring now to FIG. 5, illustrated is another exemplary sand control screen assembly 500, according to one or more embodiments disclosed. The screen assembly 500 may be similar in some respects to the screen assembly 400 of FIG. 4 and therefore may be best understood with reference thereto, where like numerals will indicate like elements not described again. Similar to the screen assembly 400 of FIG. 4, the screen assembly 500 may have primary and secondary screen assemblies 210*a,b* concentrically disposed about the base pipe 202 and bounded at each end with the first and second connector rings 208*a,b*. Specifically, the secondary screen 210*a* may be arranged adjacent the base pipe 202 and the primary screen 210*b* may be radially offset a short distance from the secondary screen 210*b* such that a concentric relationship is generated between the two screens 210*a,b* and a production annulus 502 is defined therebetween.

In one or more embodiments, one or both of the first and second connector rings 208*a,b* may have a relief valve 216 arranged or otherwise disposed therein. When opened, the relief valve(s) 216 may be configured to provide fluid communication between the formation 110 and the production annulus 502, and thereby bypass the primary screen 210*a*. In some embodiments, one or more relief valves 216 may also be arranged in or otherwise form part of the primary screen 210*a*. In at least one embodiment, one or more of the relief valves 216 arranged in the primary screen 210*a* may be low pressure burst discs, for example.

In operation, the sand control screen assembly 500 may initially draw in fluids from the formation 110 and into the interior 203 of the base pipe 202 via both the primary screen 210*a* and the secondary screen 210*b*. In particular, the primary screen 210*a* may be configured to substantially filter the incoming fluids derived from the formation 110 and feed the filtered fluids into the production annulus 502 and to the secondary screen 210*b*. The secondary screen 210*b* may be configured to convey the filtered fluids to the interior 203 of the base pipe 202 via the one or more perforations 204 radially adjacent thereto and defined in the base pipe 202.

Over time, however, the primary screen 210*a* may become plugged with particulates from the formation 110, thereby restricting fluid flow into the production annulus 502 and generating a differential pressure between the production annulus 502 (e.g., the interior 203 of the base pipe 202) and the formation 110. As the primary screen 210*a* becomes increasingly plugged, the differential pressure across the various relief valves 216 may correspondingly increase until reaching a predetermined pressure threshold, at which point one or more of the relief valves 216 may be configured to be opened or otherwise actuated to enable fluid flow therethrough. With the relief valve(s) 216 opened, fluid from the formation 110 may then be generally diverted around the primary screen 210*a* and flow into the production annulus 502 via the relief valve(s) 216. Consequently, filtration of the incoming fluids may then be undertaken using the secondary screen 210*b* which continues to feed the filtered fluids to the interior 203 of the base pipe 202 via the one or more perforations 204.

Figure 6:
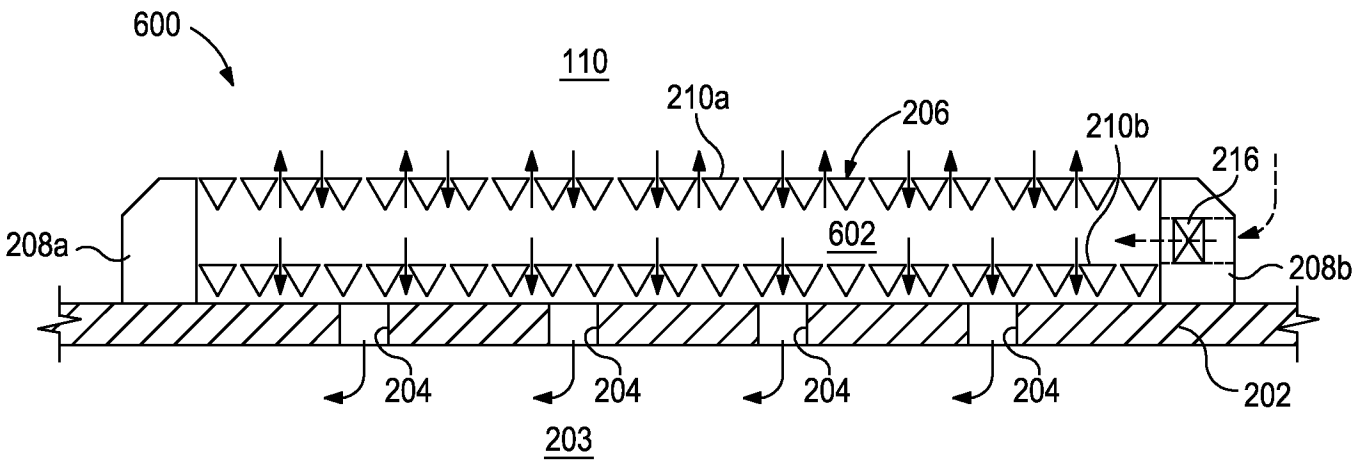
FIG. 6 illustrates another exemplary sand control screen assembly, according to one or more embodiments.

Referring now to FIG. 6, illustrated is yet another exemplary sand control screen assembly 600, according to one or more embodiments disclosed. The screen assembly 600 may be similar in some respects to the screen assemblies 400 and 500 of FIGS. 4 and 5, respectively, and therefore may be best understood with reference thereto, where like numerals will indicate like elements not described again. Similar to the screen assembly 500 of FIG. 5, the screen assembly 600 may have primary and secondary screen assemblies 210*a,b* concentrically disposed about the base pipe 202. Specifically, the secondary screen 210*a* may be arranged adjacent the base pipe 202 and bounded at each end with the first and second connector rings 208*a,b*. Moreover, the primary screen 210*b* may be radially offset a short distance from the secondary screen 210*b* such that a concentric relationship is generated between the two screens 210*a,b* and a production annulus 602 is defined therebetween.

In one embodiment, as illustrated, the second connector ring 208*b* may have a relief valve 216 arranged or otherwise disposed therein. As can be appreciated, however, the first connector ring 208*a* may alternatively have the relief valve 216 arranged therein, or both the first and second connector rings 208*a,b* may have respective relief valves 216 arranged therein. When opened, the relief valve 216 may be configured to provide fluid communication between the formation 110 and the production annulus 602, and thereby bypass the primary screen 210*a* in the event the primary screen 210*a* becomes plugged or otherwise ineffectual.

In operation, the sand control screen assembly 600 may initially draw in fluids from the formation 110 and into the interior 203 of the base pipe 202 via both the primary screen 210*a* and the secondary screen 210*b*. In particular, the primary screen 210*a* may be configured to substantially filter the incoming fluids derived from the formation 110 and feed the filtered fluids into the production annulus 602 and to the secondary screen 210*b*. The secondary screen 210*b* may be configured to convey the filtered fluids to the interior 203 of the base pipe 202 via the one or more perforations 204. Over time, however, the primary screen 210*a* may become plugged with particulates, thereby restricting fluid flow into the production annulus 602 and generating a differential pressure between the production annulus 602 (e.g., the interior 203 of the base pipe 202) and the formation 110.

As the primary screen 210*a* becomes increasingly plugged, the differential pressure across the relief valve 216 correspondingly increases until reaching a predetermined pressure threshold, at which point the relief valve 216 may be configured to open to enable fluid flow therethrough. With the relief valve 216 opened, fluid from the formation 110 may then be diverted around the plugged primary screen 210*a* and flow into the production annulus 602 via the relief valve 216. Filtration of the incoming fluids may then be accomplished using the secondary screen 210*b* which continues to feed the filtered fluids to the interior 203 of the base pipe 202 and thereby provide a continuous and uninterrupted flow of formation fluid to the surface.

In one or more embodiments, the relief valve 216 may be sized or otherwise designed such that the influx of the formation fluids into the production annulus 602 will not only be produced through the secondary screen 210*b*, but also a portion thereof may be conveyed through the primary screen 210*a* in reverse in order to help unplug the primary screen 210*a*. In other words, the influx of fluids through the relief valve 216 may serve to increase the pressure within the first production annulus 402*a* such that a portion of the incoming fluid through the relief valve 216 is conveyed in reverse through the primary screen 210*a* and may thereby remove a portion of the built-up filter cake in the process.

Removing the filter cake from the exterior of the primary screen 210*a* will allow more fluid to pass therethrough and thereby serve to reduce the pressure within the production annulus 602. As the pressure within the production annulus 602 decreases, the differential pressure across the relief valve 216 correspondingly decreases. In one or more embodiments, the relief valve 216 may be configured to close once the differential pressure descends again below the predetermined pressure threshold. For example, the relief valve 216 may be a flapper valve, or the like, and configured to open and close upon interaction with predetermined pressures. With the relief valve 216 once again in its closed position, production of fluids may again be accomplished through the concentrically arranged primary and secondary screens 210*a,b*.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A sand control screen assembly, comprising:

a base pipe having an exterior surface and defining one or more perforations;

a screen jacket disposed about the exterior surface of the base pipe and having a primary screen arranged axially adjacent a secondary screen;

a screen isolator directly coupled to and supporting the primary and secondary screens; and at least one relief valve that prevents a fluid flow from passing through both the secondary screen and the base pipe until experiencing a predetermined differential pressure generated when the primary screen becomes plugged, wherein the predetermined differential pressure opens the at least one relief valve to divert the fluid flow from the primary screen to the secondary screen.

2. The sand control screen assembly of claim 1, wherein the at least one relief valve is arranged within the screen isolator.

3. The sand control screen assembly of claim 2, wherein a first production annulus is defined between the base pipe and the primary screen and a second production annulus is defined between the base pipe and the secondary screen, and the at least one relief valve provides fluid communication between the first and second production annuli.

4. The sand control screen assembly of claim 3, further comprising:

first and second connector rings forming a mechanical interface between the base pipe and opposing ends of the screen jacket; and a flow regulator arranged within the first connector ring and configured to regulate fluid flow to the one or more perforations in the base pipe from the first and second production annuli.

5. The sand control screen assembly of claim 1, further comprising first and second connector rings forming a mechanical interface between the base pipe and opposing ends of the screen jacket, the second connector ring including a shroud extending axially from the second connector ring and the screen isolator extending radially from the shroud and engaging the base pipe, wherein the second connector ring, the shroud, and the screen isolator cooperatively define a production annulus in which the secondary screen is arranged.

6. The sand control screen assembly of claim 5, wherein the at least one relief valve is arranged in the screen isolator.

7. The sand control screen assembly of claim 5, wherein the at least one relief valve is arranged in the shroud.

8. A method for producing fluids from a formation, comprising:

introducing a base pipe into a wellbore adjacent the formation, the base pipe having a screen jacket disposed thereabout with a primary screen arranged axially adjacent to a secondary screen;

drawing a flow of fluids from the formation and into the base pipe via the primary screen;

preventing the flow of fluids from passing through both the secondary screen and the base pipe with at least one relief valve;

opening the at least one relief valve when a differential pressure between an interior of the base pipe and the formation reaches a predetermined pressure threshold; and diverting the flow of fluids through the at least one relief valve and to the secondary screen and thereby bypassing the flow of fluids through the primary screen.

9. The method of claim 8, wherein drawing the flow of fluids from the formation and into the base pipe via the primary screen further comprises trapping particulates from the formation in the primary screen and thereby increasing the differential pressure.

10. The method of claim 8, further comprising at least partially supporting the primary and secondary screens with a screen isolator disposed about the base pipe, wherein the at least one relief valve is arranged within the screen isolator.

11. The method of claim 10, wherein diverting the flow of fluids from the primary screen to the secondary screen further comprises providing fluid communication through the at least one relief valve from a second production annulus defined between the base pipe and the secondary screen and a first production annulus defined between the base pipe and the primary screen.

12. The method of claim 11, wherein the base pipe further includes first and second connector rings forming a mechanical interface between the base pipe and opposing ends of the screen jacket, the method further comprising regulating the flow of fluids into the base pipe with a flow regulator arranged within the first connector ring.

* * * * *